United States Patent [19]

Hire

[11] 4,075,724

[45] Feb. 28, 1978

[54] FOLDING BOAT

[76] Inventor: William Russell Hire, 940 W. Main St., Newark, Ohio 43055

[21] Appl. No.: 754,947

[22] Filed: Dec. 28, 1976

[51] Int. Cl.[2] ..... B63B 7/04

[52] U.S. Cl. ..... 9/2 F

[58] Field of Search ..... 9/2 R, 2 S, 2 F, 2 C; 114/77 R, 267, 266

[56] References Cited

U.S. PATENT DOCUMENTS

| | | | |
|---|---|---|---|
| 2,093,366 | 9/1937 | Robinson | 9/2 S |
| 2,879,735 | 3/1959 | Pointer | 114/266 |

FOREIGN PATENT DOCUMENTS

| | | | |
|---|---|---|---|
| 809,984 | 3/1959 | United Kingdom | 9/25 |

*Primary Examiner*—Trygve M. Blix
*Assistant Examiner*—Stuart M. Goldstein
*Attorney, Agent, or Firm*—Charles L. Lovercheck

[57] ABSTRACT

A boat made up of a foldable frame and a plurality of open-topped containers, having outwardly extending marginal flanges. The frame is made up of sections that fold into a compact unit for storage and transportation. When the frame is extended, the shoulders on the rails support the marginal flanges of the containers thereby forming a boat.

15 Claims, 11 Drawing Figures

FOLDING BOAT

REFERENCE TO PRIOR ART

The general type of foldable boat disclosed herein constitutes an improvement over the boats shown in U.S. Pat. Nos. 3,566,425; 3,684,139; 2,994,891; 2,879,735; 2,829,385; and 1,781,860.

OBJECTS OF THE INVENTION

It is an object of the invention to provide an improved foldable boat.

Another object is to provide a foldable boat that is simple in construction, economical to manufacture, and simple and efficient to use.

With the above and other objects in view, the present invention consists of the combination and arrangement of parts hereinafter more fully described, illustrated in the accompanying drawings and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
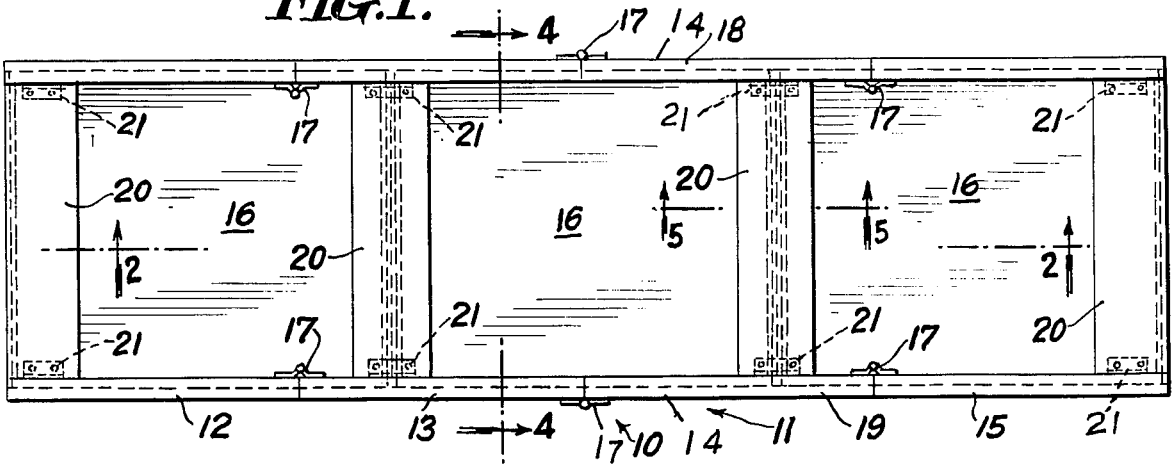
FIG. 1 is a top view of a boat according to one embodiment of the invention.
Figure 2:
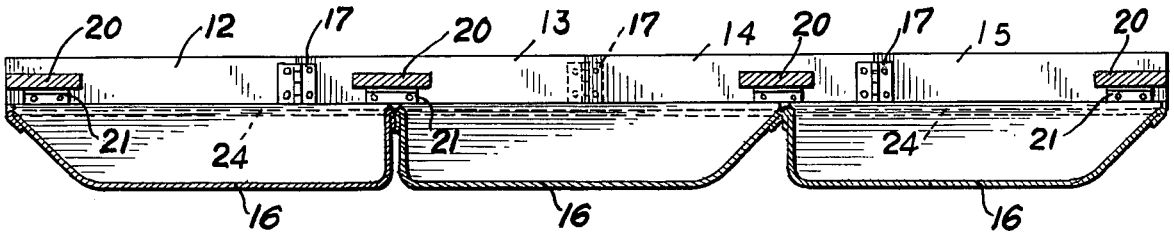
FIG. 2 is a longitudinal cross-sectional view taken on line 2—2 of FIG. 1.
Figure 3:
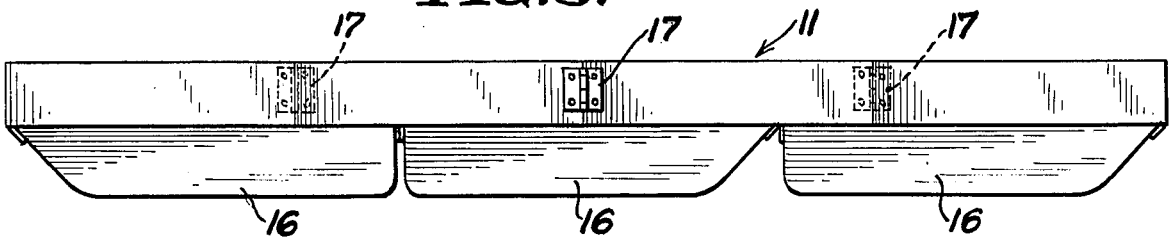
FIG. 3 is a side view of the embodiment of FIGS. 1 and 2.
Figure 4:
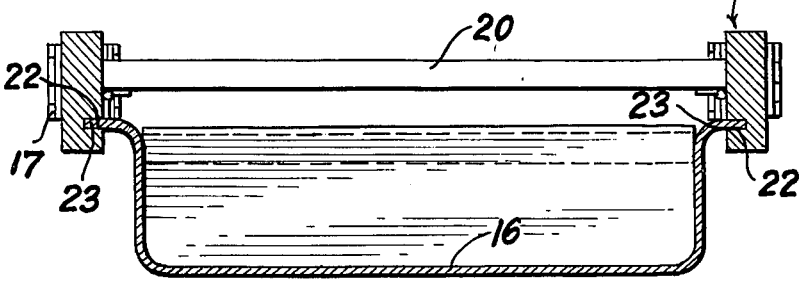
FIG. 4 is a lateral cross-sectional view taken on line 4—4 of FIG. 1.
Figure 5:
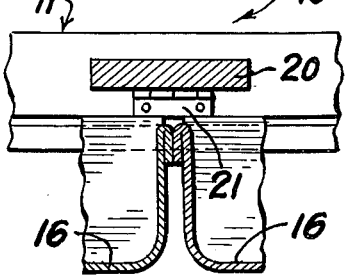
FIG. 5 is an enlarged partial cross-sectional view taken on line 5—5 of FIG. 1.

The foldable boat shown herein, indicated generally at 10, comprises, in combination, the foldable frame 11 and a plurality of open-topped containers 16.

The frame 11 is made up of a plurality of sections 12, 13, 14 and 15 that are hingedly connected together by first hinges 17.

Each of the side rails 18 and 19 is made up of sections 12, 13, 14 and 15 disposed in spaced relation to each other, and the cross members 20 are connected to the side rails 19 by means of second hinges 21 to swing about pivots having an axis disposed at right angles to the axis of first hinges 17.

The side rails 18 and 19 each have longitudinally extending slot 24 which has a surface 22 that is upwardly facing when the frame is in the extended position shown in FIGS. 1, 2, 3 and 4. Marginal flanges 23 of the containers 16 rest on the surface 22 when the boat is in assembled position. The frame will be unfolded and the flanges 23 of each of the containers 16 will be slid inward from the end of the frame through the slots 24 over the surface 22. When the containers are removed from the frame 11, the side rails can be swung inwardly about the hinges 21. When the side rails are swung inwardly, the surfaces 22 are disposed in parallel planes spaced from each other. The sections 12, 13 14 and 15 can then be swung about hinges 17 toward each other until they rest on each other and are disposed in parallel planes.

Each alternate hinge 17 is disposed on the outside of the side rails and each other alternate hinge 17 is disposed on the inner side of the side rails 18 and 19.

The containers each have a bottom and four sides. Two container sides have on opposite sides of the container flanges 23 extending outwardly and presenting a lower surface that rests on the surface 22 of the side frame when the boat is assembled for use.

Figure 6:
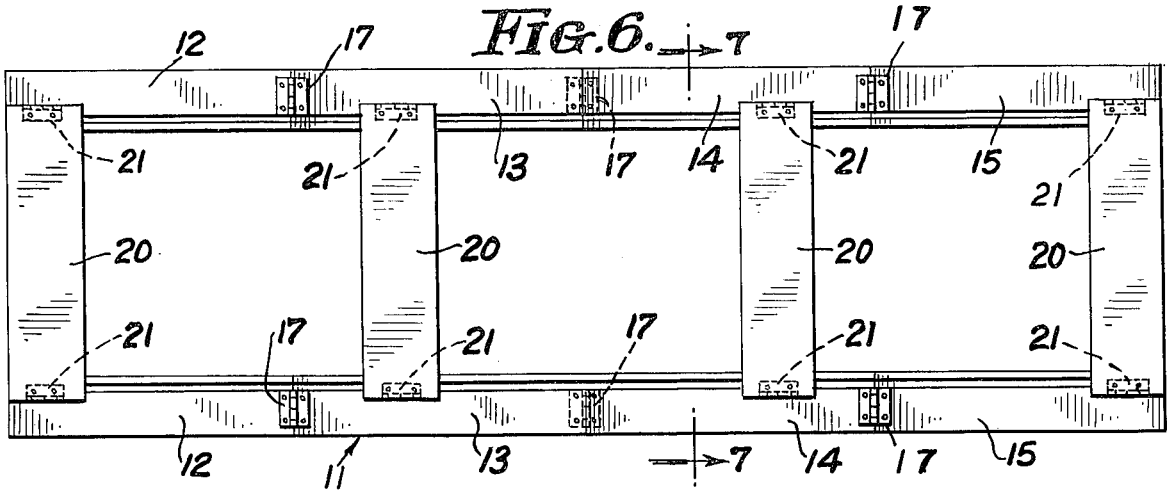
FIG. 6 is a top view of the frame with the open-topped containers removed and the side rails folded.

When the frame is extended in the manner shown in FIG. 6, with the containers 16 removed, the frame has the appearance of a ladder with spaced side rails and lateral seat members. When the containers extend across the hinged joints, the ladder-like frame cannot collapse because the containers hold the rail in place. The lateral members function as seats overlying the junction of the containers and length of the boat.

As many frame sections 12–15 as desired may be used and the containers can be made any desired size, depending on the use to be made of the boat.

Figure 9:
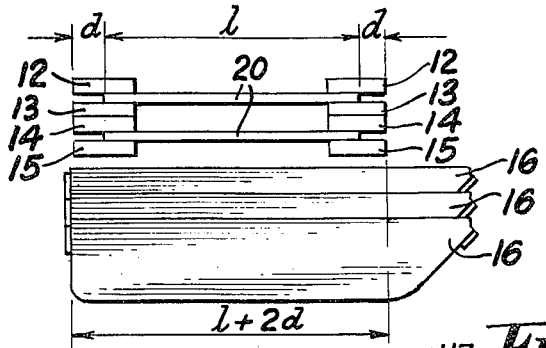
FIG. 9 is a view showing the containers nested and the frame folded.
Figure 10:
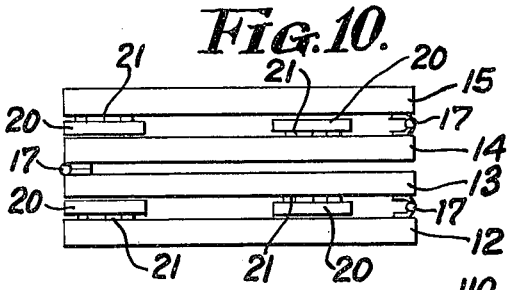
FIG. 10 is an enlarged view of the folded frame.

When the containers are removed and the frame is folded, as shown in FIGS. 9 and 10, the length of the frame may be approximately equal to the width of the boat, and the containers can be nested one within the other for convenience, storage and transportation.

Figure 11:
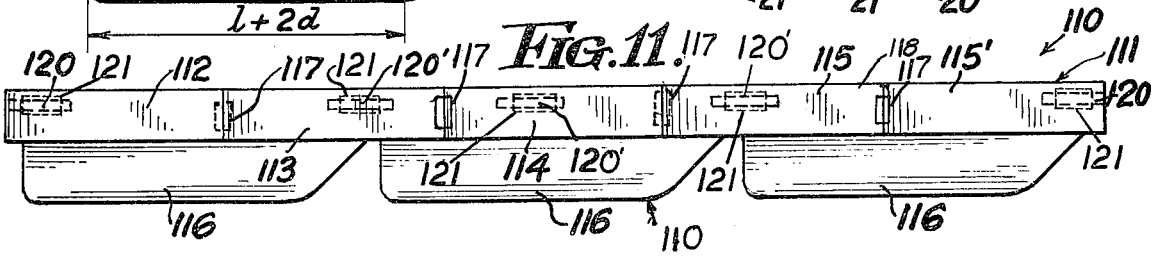
FIG. 11 is a schematic side view of another embodiment.

The embodiment of the boat shown in FIG. 11 shows a boat 110 having a frame 111 made up of side rails 118 having five sections 112, 113, 114, 115, and 115'. The side rails are hinged together by first hinges 17 and the side rails 118 are connected together by laterally-extending members 120. The first laterally-extending members 120 at the ends and at the center of the boat can be made wide enough for seats. The second laterally-extending members 120' which overlie the side of the adjacent edges of the containers 116 may be made in the form of narrow bars to provide reinforcing structure. All of the laterally-extending members 120 and 120' will be pivoted to the side rails be second hinges 121. The lateral members 120' may be narrower than the members 120, thus, members 120 may be used as seats and the members 120' will reinforce the frame yet will not take up unnecessary space in a short boat.

The length of the boat, for example, will be divisible by both 5 and 3. A boat 15 feet long would have five 3-foot frame sections 12, 13, 14, 15 and 15' and the three containers 116 would each be 5-feet long and 3-feet wide, wide enough to receive the folded frame. Thus, the 5-foot containers when nested as shown in FIGS. 9 and 10, could contain the folded frame.

Figure 7:
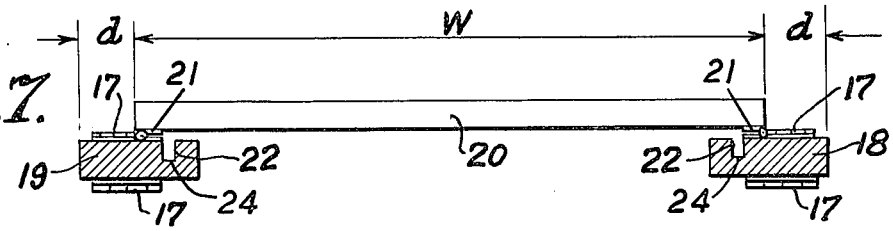
FIG. 7 is a cross sectional view taken on line 7—7 of FIG. 6.
Figure 8:
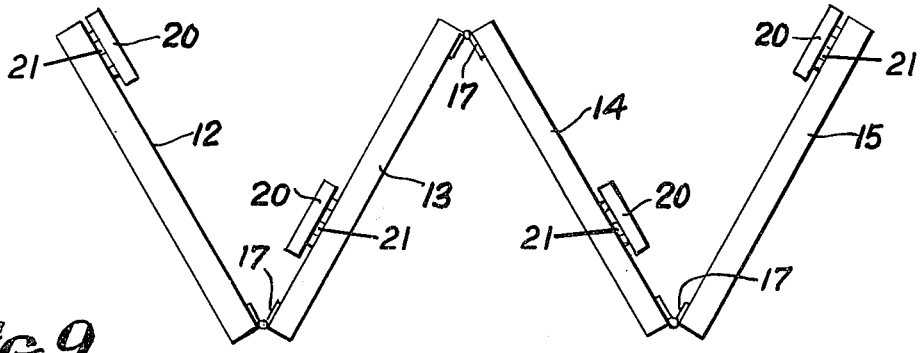
FIG. 8 is a side view of the frame in partly folded position.

In the case of a four-section frame, the length of each frame section must be less than the width of the container plus $2d$ wherein $d$ is the distance from the edge of a seat to the top surface of the side rails when the side rails are folded inwardly as shown in FIGS. 7 and 9.

The length of the containers must be such that the frame, when folded, will rest on the bottom of the containers with the width of the containers disposed lengthwise.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A folded boat comprising,
in combination, a foldable frame made of a plurality of sections and a plurality of open-topped containers,
said frame comprising laterally-spaced side rails and a plurality of lateral members extending generally perpendicular to said side rails,
each said side rail comprising a plurality of rail members hingedly connected together,
each said side rail having an upwardly facing shoulder formed thereon,
each said container comprising a bottom, side walls and end walls,
each said side wall of said container terminating in a laterally-extending flange extending generally perpendicular to said side walls,
said longitudinally-extending flanges being integrally attached to each said container and extending generally perpendicular thereto,
a second hinge means on each lateral member whereby said lateral members are hingedly connected to said side rails,
said second hinge means being swingably connected to said side rails,
said second hinge means being swingably connected about an axis generally perpendicular to the axis of said first mentioned hinge means whereby said side rails may be swung to underlie said lateral members and said side rails can then be swung toward each other,
said shoulder being disposed substantially in a common plane when said side rails are in extended position whereby said shoulders may support said flanges of said containers.

2. The foldable boat recited in claim 1 wherein flange members are disposed adjacent the upper edge of said side rails.

3. The foldable boat recited in claim 2 wherein some of said second hinge means are attached to the top side of said side rails when said rails are folded.

4. The boat recited in claim 1 wherein said boat has three containers and said frame has at least four sections.

5. The boat recited in claim 1 wherein said boat has at least three containers and said frame has at least five sections.

6. The boat recited in claim 1 wherein each said container has a width at least as great in length of one said section and a length at least as great as the width of said lateral members.

7. The foldable boat recited in claim 1 wherein said upwardly-facing shoulder on each said side rail comprises one side of a slot in each said side rail.

8. The boat recited in claim 7 wherein said slot in each of said rails is aligned with a slot in a said rail adjacent thereto forming a continuous slot through which a said flange can be moved through from one end of said boat to the other.

9. A foldable boat comprising in combination
a foldable frame having a plurality of substantially rigid, relatively adjoining sections and a plurality of open-topped containers,
each of said sections including a pair of relatively spaced apart longitudinally-extending side rails and at least one seat-forming member extending transversely between said side rails,
means rotatably connecting the side rails of each of said sections to said seat-forming members thereof and providing for axial turning movement only of said side rails with respect to said seat-forming members,
and hinge means connecting the side rails of one of said sections to the side rails of an adjoining section,
said hinge means including lineal hinge axes disposed in perpendicular relation to the longitudinal axes of said side rails,
and said hinge means being bodily turnable with said side rails between a first position in which the hinge axes of said hinge means are disposed in parallel relation to the longitudinal axes of said seat-forming members to permit said sections to be folded with respect to one another and a second position in which said hinge axes are disposed in perpendicular relation to the longitudinal axes of the said seat-forming members to thereby lock said sections against relative folding movement,
ledge means on said side rails having an upwardly disposed ledge thereon on the side thereof having said hinge means thereon,
said containers each having outwardly-extending rim means thereon adapted to rest on said ledge means whereby said containers are supported by said side rails and said side rails are restrained against swinging to said first position thereby providing a rigid boat.

10. The combination recited in claim 9 wherein said means rotatably connected to said side rails to each of said sections on said seat-forming members comprise
hinges fixed to the sides of said rails adjacent said containers when said rails have said containers disposed therebetween.

11. The combination recited in claim 9 wherein said ledge means comprise slot means formed on the inner edges of said side rails,
said slot means being adapted to receive said rim means on said containers.

12. A boat comprising a foldable frame made up of a plurality of substantially rigid, relatively adjoining frame sections and a plurality of containers,
each said section including a pair of relatively spaced apart, longitudinally extending side rails and at least one seat forming member extending traversely between said side rails,
means rotatably connecting said side rails of each of said sections to the seat forming members thereof and providing for axially turning movement only of said side rails with respect to said seat forming members,
and hinge means connecting the said side rails of one of said sections to the side rails on adjoining section,
said hinge means including lineal hinge axis disposed in perpendicular relation to the longitudinal axis of said side rails and said hinge means being turnable bodily with said side rails between a first position in which the hinge means of said side rails are disposed in parallel relation to the longitudinal axis of said seat forming members to permit said sections to be folded with respect to one another to a second position in which said hinge means are disposed in perpendicular relation to the longitudinal axis of said seat forming members to thereby lock said sections against relative folding movement, said side rails each having an upwardly facing shoulder on each said side rail member, said containers each having outwardly directing flanges each adapted to rest on a said upwardly facing shoulder whereby said frame is further locked against folding movement, said containers being removeable from said frame, and said frame sections being foldable in stacked relation whereby said containers and said frame sections may be disposed in compact relation for transportation and storage.

13. The boat recited in claim 12 wherein said containers each have outwardly extending sides and a bottom, said sides and said bottom being disposed below said flanges.

14. The boat recited in claim 12 wherein said boat has at least one container engaging each said frame section, and said frame has means thereon for cooperating with said flanges for holding said frame in extending relation to when said flanges of said containers are in operative position to said frame.

15. The boat recited in claim 14 wherein said boat has a width at least as great as the length of one of said rail members and a length at least as great as the width of said lateral members.

* * * * *